United States Patent [19]

Takagi et al.

[11] Patent Number: 4,738,297

[45] Date of Patent: Apr. 19, 1988

[54] METHOD OF SPRAY APPLYING MOLD-RELEASE AGENT TO A DIE CASTING MOLD

[75] Inventors: Norikazu Takagi, Kosai; Yoshihiko Iwasaki, Okazaki; Ryuji Koyama, Kosai, all of Japan

[73] Assignee: Asmo Co., Ltd., Shizuoka, Japan

[21] Appl. No.: 933,928

[22] Filed: Nov. 24, 1986

[30] Foreign Application Priority Data

Nov. 26, 1985 [JP] Japan ..... 60-265439

[51] Int. Cl.[4] ..... B22D 17/20

[52] U.S. Cl. ..... 164/72; 164/149; 164/305

[58] Field of Search ..... 164/72, 149, 267, 305

[56] References Cited

U.S. PATENT DOCUMENTS 3,349,833 10/1967 Hodler ..... 164/305 X 3,645,319 2/1972 Pondelicek et al. ..... 164/72

3,779,305 12/1973 Pondelicek et al. ..... 164/72 X 4,562,875 1/1986 Ogoshi et al. ..... 164/72

FOREIGN PATENT DOCUMENTS 632477 11/1978 U.S.S.R. ..... 164/149

984658 1/1983 U.S.S.R. ..... 164/267

*Primary Examiner*—Nicholas P. Godici

*Assistant Examiner*—J. Reed Batten, Jr.

*Attorney, Agent, or Firm*—Birch, Stewart, Kolasch & Birch

[57] ABSTRACT

A mold-release agent injection nozzle is provided in the portion of the die casting machine leading to the mold cavity or in the mold. A mold-release agent is then spray applied to the surfaces of the mold through the nozzle while the mold is closed. The surplus mold-release agent is then discharged through a vent port having a displaceable valve.

2 Claims, 3 Drawing Sheets

METHOD OF SPRAY APPLYING MOLD-RELEASE AGENT TO A DIE CASTING MOLD

TECHNICAL FIELD

This invention relates to a method of and a device for spray applying mold-release agent for facilitating the removal of a cast article from a mold during the die casting operation.

BACKGROUND ART

Spray applying of mold-release agent onto a mold for die casting has heretofore been effected by a spray head 11, mounted on the exterior of the mold with the mold opened as shown in FIG. 6. Some prior art method used a release agent spraying nozzle provided in the interior of a mold, but still it effected the spray applying with the mold open.

Since the prior art method spray applied a mold-release agent with the mold open, it was quite difficult to spray apply a mold-release agent selectively only to those portions of a mold which were contacted by molten metal such as aluminum and which were required to be covered with a release agent, such as casting surfaces, sprues, molten metal wells, air vents and the like as will be hereinafter generally referred to as cavity section, so that the release agent was also applied to those portions of the mold other than the cavity section which were not required to be covered with release agent, such as parting surfaces of the mold and sliding surfaces of a movable mold insert. As mold-release agent was repeatedly spray applied to a mold, it gradually built up on those portions of the mold other than the cavity section. The thickness of the build-up of release agent itself or of aluminum tailings adhered to the sticky release agent formed gaps between the parting surfaces of the mold even when it was closed, so that molten aluminum flowed into such gaps to form flashes, resulting in the need for a deflashing step each time after the casting process. In addition, the increasing thickness of the release agent build-up and the adhered aluminum tailings caused unevenness in dimensions of cast articles.

Furthermore, since mold-release agent was spray applied to the mold from the exterior thereof with the mold open, all of the release agent did not adhere to the mold, not only resulting in lower efficiency in the application of release agent and a relatively large loss of release agent, but also causing some surplus release agent to scatter around, thereby contaminating the surrounding environment.

SUMMARY OF INVENTION

The present invention contemplates solving the aforesaid problems with the prior art, and to that end provides a method of and device for spray applying a mold-release agent to those surfaces of a mold of a die casting machine that are to be contacted by molten metal. This method comprises the steps of providing a mold-release agent injecting nozzle in that portion of the die casting machine leading to the mold cavity or in the mold, spray applying a mold-release agent to said surfaces of the mold through said nozzle while the mold is closed, and discharging a surplus of the mold-release agent out through a vent port leading to the mold cavity.

According to this invention, a mold-release agent is injected through a release agent injecting port connected with a molten metal passage intermediate the ends thereof to fill a mold cavity while the mold is closed, and a surplus of the release agent is discharged out through a vent port and recovered for reuse, whereby the release agent is prevented from adhering to the portions of the mold which are not required to be covered with release agent and from scattering out of the mold. Loss of the release agent is also minimized.

Release agent may be injected under pressure through the injecting port. Alternatively, spray applying of release agent may be effected by maintaining the mold cavity at a reduced pressure by connecting the vent port with a vacuum tank or the like disposed on the exterior of the mold, thereby not only enabling the application of release agent in a more efficient manner and in a shorter time, but also facilitating collection of a surplus of the release agent.

Further scope of applicability of the present invention will become apparent from the detailed description given hereinafter. However, it should be understood that the detailed description and specific examples, while indicating preferred embodiments of the invention, are given by way of illustration only, since various changes and modifications withing the spirit and scope of the invention will become apparent to those skilled in the art from this detailed description.

BRIEF DESCRIPTION OF THE DRAWINGS

These and other objects and features of the present invention are more fully disclosed in the following specification, reference being had to the accompanying drawings which are give by way of illustration only, and thus are not limitative of the present invention and in which.

DETAILED DESCRIPTION OF THE PREFERRED EMBODIMENTS

Figure 1:
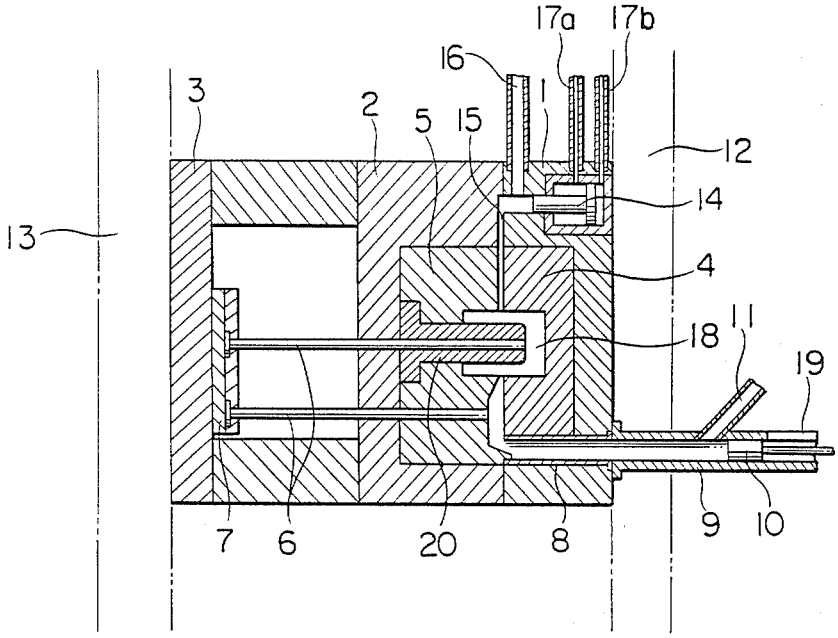
FIG. 1 is a cross-sectional view of a die casting machine arranged to practise a method of spray applying a mold-release agent according to the present invention.

FIG. 1 illustrates one form of die casting machine arranged to practice one embodiment of the method of spray applying a mold-release agent according to the present invention.

The mold of this machine comprises a fixed matrix 1 secured to a fixed base plate 12 of the machine and a movable matrix 2 secured to a movable platen 13 by means of a die base 3. A fixed mold insert 4 and a movable mold insert 5 are inserted in and secured to the matrices 1 and 2, respectively by means of bolts (not shown). A core 20 is held by the mold insert 5 and extends inwardly therefrom to define a mold cavity 18 with the inserts 5 and 4.

A pair of ejection pins 6 extend from an ejection plate 7 through the matrix 2 and the core 20 and insert 5 which are reciprocally movable to eject a cast article.

A sprue bushing 8 is passed through the mold insert 4 and matrix 1 and is connected with a plunger sleeve 9 which extends through the base plate 12 and is fixed to the matrix 1. A plunger 10 is mounted in the plunger sleeve 9 for reciprocal movements to inject molten metal through the plunger and sprue bushing 8 into the mold cavity. The plunger sleeve is provided adjacent its outer end with a molten metal inlet 19. A mold-release agent injecting port 11 is connected with the plunger sleeve intermediate the ends thereof.

An air vent channel 15 in communication with the mold cavity is formed through the movable insert 5 and matrix 2 and through the fixed matrix 1 and leads to an exterior exhaust port 16. The vent channel 15 is adapted to be closed and opened by exhaust valve means 14 disposed in the fixed matrix 1. The valve means may be in the form of a double acting hydraulic piston-cylinder having hydraulic tubes 17*a* and 17*b* connected with first and second chambers, respectively on the opposite sides of the piston in the cylinder. A valve member in the form of a piston rod is reciprocated to close and open the vent channel 15.

An embodiment of the method of spray applying a mold-release agent according to the present invention employing the apparatus described above will now be explained with reference to FIGS. 2 to 5.

Figure 2:
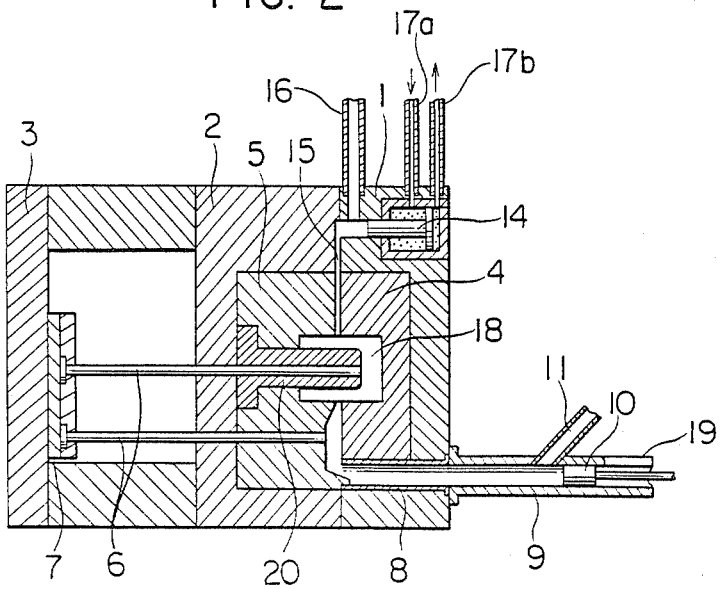
FIGS. 2 to 5 are cross-sectional views of the machine similar to FIG. 1 but illustrating different phases of the release agent applying operation.

In FIG. 2 the plunger 10 is first moved to close the molten metal inlet 19. Hydraulic fluid is introduced through the tube 17*a* into the first chamber of the valve means 14 to move it to its open position to thereby communicate the vent channel 15 with the vent port 16.

Figure 3:
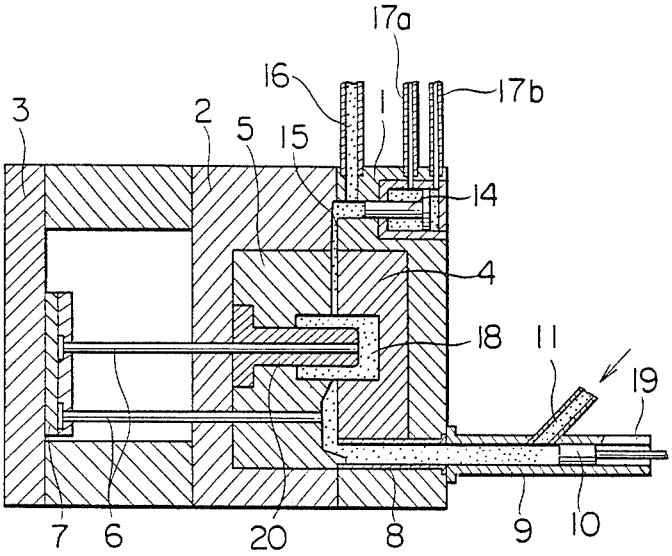

As shown in FIG. 3, a mold-release agent is then injected through the injection port 11 to fill the mold cavity 18. Injection of release agent may be effected either under pressure or by drawing a vacuum through the vent port 16. The release agent is caused to impinge on and adhere to those casting surfaces of the mold inserts 4, 5 and core 20 which are to be contacted by molten metal.

Figure 4:
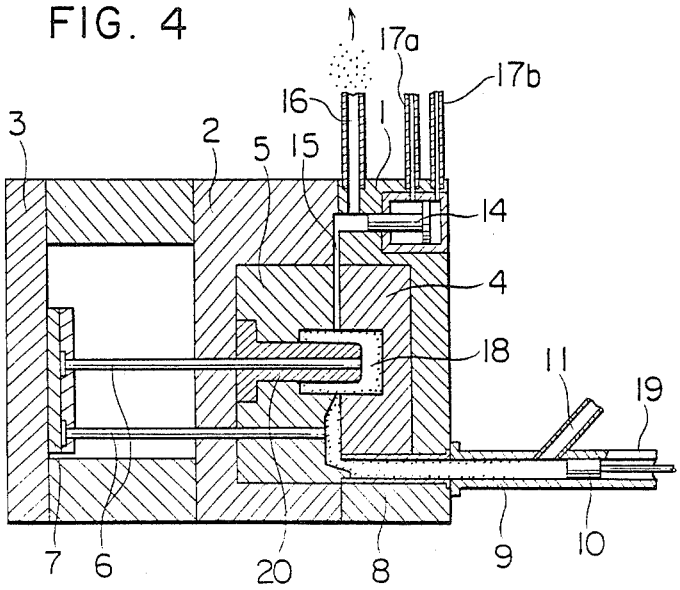
Figure 5:
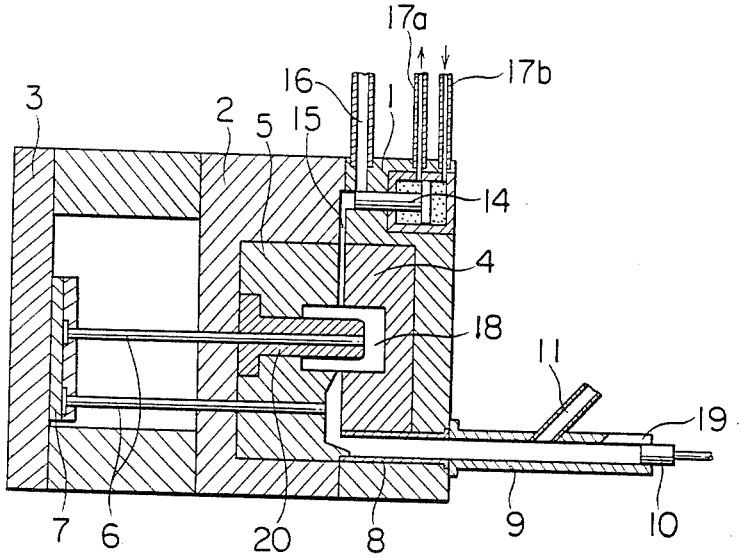
Figure 6:
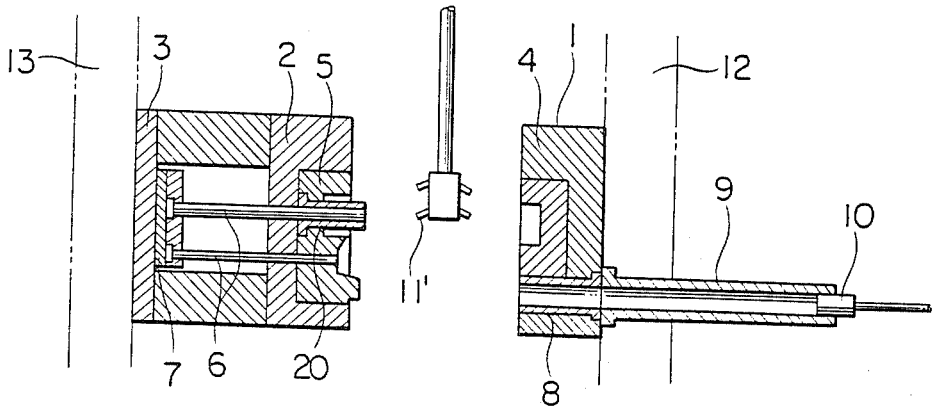
FIG. 6 PRIOR ART
FIG. 6 is a cross-sectional view of a prior art die casting machine illustrating a conventional method of spray applying a release agent.

The portion of the release agent freely suspended in the mold cavity 18 is discharged out through the vent channel 15 and vent port 16, as shown in FIG. 4.

Upon completion of the release agent applying operation, hydraulic fluid is introduced through the tube 17*b* into the second chamber of the valve means 14 to move it to its closed position to thereby shut off the communication between the vent channel 15 and vent port 16.

Then, the plunger 10 is retracted to open the molten metal injection inlet 19 preparatory to injecting molten metal.

It is to be appreciated from the foregoing description that according to this invention a release agent is spray applied through a release agent injection port or nozzle connected with either a plunger sleeve in communication with the mold cavity section or a release agent injection port provided in a part of the cavity section while the mold is closed, whereby deposition of release agent on the portions of the mold which are not required to be coated with release agent is prevented, thereby avoiding formation of flashes and unevenness in dimensions of cast articles. In addition, as the application of release agent is effected with the mold closed, any minor gap at the parting line of the mold due to lack of manufacturing accuracy is filled with the release agent, reducing the occurrence of flashes. Furthermore, the efficiency in adherence of release agent to the casting surfaces is enhanced to thereby reduce the amount of release agent consumed. Moreover, pulverized release agent may be spray applied to the casting surfaces in the state of powders, so that the release agent will produce no gas of decomposition upon contacting molten metal, thereby prevented contraction voids from being formed in a cast article.

The above description is intended to illustrate the preferred embodiments of the present invention and is not meant to limit the scope of the invention. The scope of the invention is to be limited only by the following claims. From the above description, many variations will be apparent to one skilled in the art that would yet be encompassed by the spirit and scop of the invention.

What is claimed:

1. A method of spray applying a mold-release agent to surfaces of a mold of a die casting machine that are contacted by molten metal, said mold including a mold cavity, comprising the steps of:

providing a mold-release agent injection nozzle in a portion of the die casting machine leading to the mold cavity;

providing positively driven vent valve means in a vent channel for a mold-release agent leading from said mold cavity and to a vent port;

opening the valve means for communicating the vent channel with the vent port;

spray applying a mold-release agent to said surfaces of the mold through said nozzle while the mold is closed;

discharging a surplus of the mold-release agent through the vent channel and vent port;

closing the valve means to terminate the communication between the vent channel and the vent port, and supplying molten metal to the die casting machine.

2. The method of spray applying according to claim 1 further comprising the steps of:

providing a plunger sleeve between said mold-release agent injection nozzle and said mold cavity;

providing a molten metal inlet connected to said plunger sleeve;

providing a movable plunger in said sleeve;

closing said molten metal inlet from said mold cavity during said spray applying by said plunger;

moving the plunger to an open position to permit access from said molten metal inlet to said mold cavity through said plunger sleeve.

* * * * *